US007506697B2

(12) United States Patent
Pflieger

(10) Patent No.: US 7,506,697 B2
(45) Date of Patent: Mar. 24, 2009

(54) RECOIL AUGER WITH CLUTCH BEARING

(76) Inventor: David C Pflieger, 235 Park Rd., Two Rivers, WI (US) 54241

( * ) Notice: Subject to any disclaimer, the term of this patent is extended or adjusted under 35 U.S.C. 154(b) by 192 days.

(21) Appl. No.: 11/274,846

(22) Filed: Nov. 15, 2005

(65) Prior Publication Data

US 2007/0107945 A1 May 17, 2007

(51) Int. Cl.
*E21B 10/44* (2006.01)

(52) U.S. Cl. ..... 175/57; 175/18; 175/394

(58) Field of Classification Search ..... 166/18, 166/57, 323, 394
See application file for complete search history.

(56) References Cited

U.S. PATENT DOCUMENTS

| | | | | |
|---|---|---|---|---|
| 1,294,098 | A | 2/1919 | Hardtke | |
| 2,266,865 | A | 12/1941 | Herrington | |
| 2,393,282 | A | 1/1946 | Berlin | |
| 2,476,047 | A | 7/1949 | Kidder | |
| 2,846,192 | A * | 8/1958 | Ostling | 175/18 |
| 3,051,253 | A | 8/1962 | McCann | |
| 3,710,877 | A | 1/1973 | Michasiw | |
| 3,828,861 | A | 8/1974 | Verkuil | |
| 3,929,196 | A | 12/1975 | Rantanen | |
| 4,116,284 | A | 9/1978 | Cox | |
| 4,817,735 | A | 4/1989 | Corrigan | |
| 5,038,870 | A | 8/1991 | Kuronen | |
| 5,163,393 | A | 11/1992 | Näslund | |
| 5,673,761 | A * | 10/1997 | Berner | 175/18 |
| 5,950,738 | A * | 9/1999 | Caswell et al. | 175/18 |
| 6,125,951 | A * | 10/2000 | Bowser | 175/203 |
| 2007/0107936 | A1 * | 5/2007 | Pflieger | 175/18 |

FOREIGN PATENT DOCUMENTS

| | | |
|---|---|---|
| EP | 0 623 743 | 11/1994 |
| JP | 60-224957 | 11/1985 |
| JP | 11-220923 | 8/1999 |
| JP | 2000-54770 | 2/2000 |
| JP | 2003-254204 | 9/2003 |

* cited by examiner

*Primary Examiner*—Kenneth Thompson
*Assistant Examiner*—David Andrews
(74) *Attorney, Agent, or Firm*—Ryan Kromholz & Manion S.C.

(57) ABSTRACT

A recoil auger enables holes to be drilled by using only straight line motions of a person's hand, arm, and shoulder. The recoil auger is comprised of a recoil drive system connected to an output shaft, which in turn is connected to an auger. The recoil drive system has a recoil mechanism that imparts unidirectional rotation to the auger in response to bidirectional rotation of the recoil mechanism. The recoil mechanism includes a clutch bearing to unidirectionally rotate the auger. The recoil drive system has a handle that the person grasps during operation. Operation is achieved by pulling a rope wound around a rope wheel. A recoil spring rewinds the rope after a pulling motion. Multiple recoil mechanisms assembled to the output shaft and one or more suitable handles enable more than one person to operate the recoil auger at the same time.

15 Claims, 6 Drawing Sheets

RECOIL AUGER WITH CLUTCH BEARING

BACKGROUND OF THE INVENTION

1. Field of the Invention

The present invention pertains to manually operated augers, and more particularly to apparatus that uses straight line manual motions to rotate an auger.

2. Description of the Related Art

Augers for drilling in ice and earth are well known and in widespread use. Augers typically include a center shaft. A helical band with a cutting edge at one end surrounds the center shaft. Rotating the center shaft causes the cutting edge to cut into the ice or earth. The helical band pushes the cut material away from the cutting edge to make a hole.

Some prior augers were manually driven. Manual augers were usually light weight, fairly inexpensive, and relatively easy to carry. An example of a prior manual auger, which uses a crank and gear mechanism, may be seen in U.S. Pat. No. 1,294,098. U.S. Pat. No. 4,817,735 shows a foot powered auger. Perhaps the classic example of prior manual augers is described in U.S. Pat. Nos. 2,393,282; 2,476,047; 3,051,253; 3,929,196; and 5,038,870. Those five patents each show an offset handle connected to an auger center shaft. A person grasped the handle with one hand and steadied the auger with the other hand. The person exerted his shoulder and arm muscles to produce a circular motion with his first hand, thus turning the handle and the auger.

When using a manual auger with an offset handle, multiple combinations of forces had to be generated by the person for each revolution of his hand. Specifically, a first force was generated to pull the hand in a first motion toward his body. Then the handle was forced across the front of the body in a second motion. Then, the person had to push the handle away from his body in a third motion. Finally, the person forced the handle across the front of his body in a fourth motion opposite the second motion. The process was repeated for each revolution of the handle and auger.

Because of the nature of ice and earth, considerable effort was required to drill holes with offset handle augers. Ergonomically, it was very difficult for most people to perform three of the four handle motions. The only motion that most people could complete with ease was the first motion of pulling the hand toward the body. That was a fairly natural motion during which most people could generate the maximum force with their arms and shoulder muscles. In general, younger, older, and other persons without adequate strength could not easily use the prior manual augers.

To ease the task of drilling in ice and earth, power driven augers have been developed. A common power source was a gasoline engine that connected to the auger center shaft. Some augers were powered from remote locations by suitable transmissions. U.S. Pat. Nos. 3,710,877; 3,828,861; and 4,116,284 illustrate different kinds of remote power sources and associated transmissions. Japan patent application number 1998000220506 teaches an auger powered by a motor and assembled to the end of a crane boom.

There are several disadvantages associated with power augers. In addition to being undesirably expensive, they are heavy and awkward to carry. The engines are subject to environmental standards, including emission controls and anti-noise ordinances. A related problem concerns the odors emitted from the engine, which is only an arm's length from the user's face. The noise and emissions make it an unpleasant task to drill holes with power augers. Moreover, power augers develop high torque, so safety is a major concern.

Thus, a need exists for improvements in ways to operate augers.

SUMMARY OF THE INVENTION

In accordance with the present invention, a recoil auger with a clutch bearing is provided that requires a person to exert only bi-directional straight line motions of the person's hand, arm, and shoulder to operate. This is accomplished by apparatus that includes a recoil mechanism that imparts unidirectional motion to an auger.

The auger has an auger shaft and a helical band around the shaft. A working end of the helical band at the auger first end is sharpened. A second end of the auger shaft is connected to the recoil mechanism. The recoil mechanism is part of a recoil drive system that also includes a housing and a handle.

According to one aspect of the invention, the housing is rotatably mounted to one end of a drive shaft, which may be either the auger shaft or a separate output shaft connected to the auger shaft. The recoil mechanism utilizes a one-way clutch bearing to impart unidirectional motion to the drive shaft in response to straight line motions exerted by a person. The recoil mechanism also includes a mounting sleeve secured to the drive shaft. On the mounting sleeve is the one-way clutch bearing. The outer race of the clutch bearing supports a rope wheel. Rotating the rope wheel in a first direction also rotates the mounting sleeve and the drive shaft. Rotating the rope wheel in the second direction has no effect on the mounting sleeve or drive shaft. A recoil spring biases the rope wheel to rotate in the second direction relative to the mounting sleeve and drive shaft. A rope with a pull handle is wound on the rope wheel. The rope is wound such that pulling the pull handle rotates the rope wheel in the first direction.

In operation, a person grasps the handle with one hand and the rope pull handle with the other hand. He pulls the rope pull handle in a straight line motion with his hand, arm, and shoulder to rotate the auger. Upon releasing the rope pull handle in an opposite straight line motion, the recoil spring rotates the rope wheel back to the starting position, rewinding the rope without manual effort and without effect on the auger.

Further in accordance with the present invention, more than one recoil mechanism may be incorporated into the recoil auger. Each recoil mechanism has its own rope wheel and clutch bearing. Different persons pull respective rope pull handles, thereby increasing the speed and torque that can be applied to the auger. The one-way clutch bearings enable pulling and rewinding each rope independently of the other ropes.

To further increase the convenience of using the invention, a separate handle may be incorporated into the recoil auger for each recoil mechanism.

It is a feature of the invention that the auger may be disconnected from the recoil drive system. For that purpose, the drive shaft constitutes the separate recoil mechanism output shaft, which is disconnectable from the auger shaft. The free end of the output shaft is designed to selectively connect to and disconnect from the auger shaft. In that manner, the recoil auger of the invention may be broken down for easily transportation.

The method and apparatus of the invention, using just straight line bi-directional motions by a person, thus enables holes to be drilled in an ergonomically satisfactory way. The probability of unsuccessful operation is remote, even though he may not have adequate strength to generate forceful circular motions with his hand, arm, and shoulder.

Other advantages, benefits, and features of the invention will become apparent to those skilled in the art upon reading the detailed description of the invention and studying the drawings.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
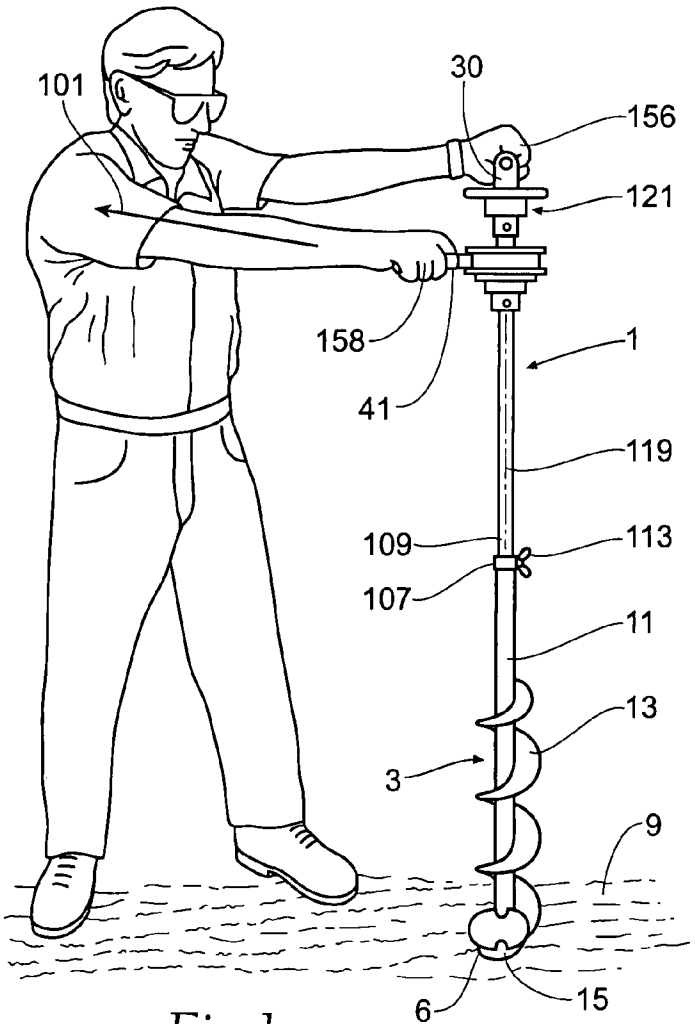
FIG. 1 is a perspective view of the present invention in use at the start of a pull stroke of the recoil mechanism.

Looking first at FIG. 1, a recoil auger 1 is illustrated that includes the present invention. The recoil auger 1 is particularly useful for drilling holes in ice or earth, typically represented at reference numeral 9. However, it will be understood that the invention is not limited to outdoor related applications.

The particular recoil auger 1 illustrated is comprised of an auger 3 connected to a manual recoil drive system 121. The auger 3 preferably has a sharpened end 6 opposite the recoil drive system 121. Operation of the recoil drive system causes rotation of the auger about a longitudinal axis 122 of the recoil auger to drill into the ice or earth 9.

The auger 3 includes an auger shaft 11 around which is a helical band 13. The auger sharpened end 6 may be in the form of a knife 15.

In the preferred embodiment, the recoil drive system 121 is disconnectable from the auger 3. For that purpose, the auger shaft 11 has a socket 107 that receives an end 109 of a separate recoil drive system output shaft 119, as will be explained shortly. A thumb screw 113 is used to hold the shafts 11 and 119 to each other and concentric to the longitudinal axis 122. In that manner, the recoil auger 1 can be broken down for easy transportation.

Figure 3:
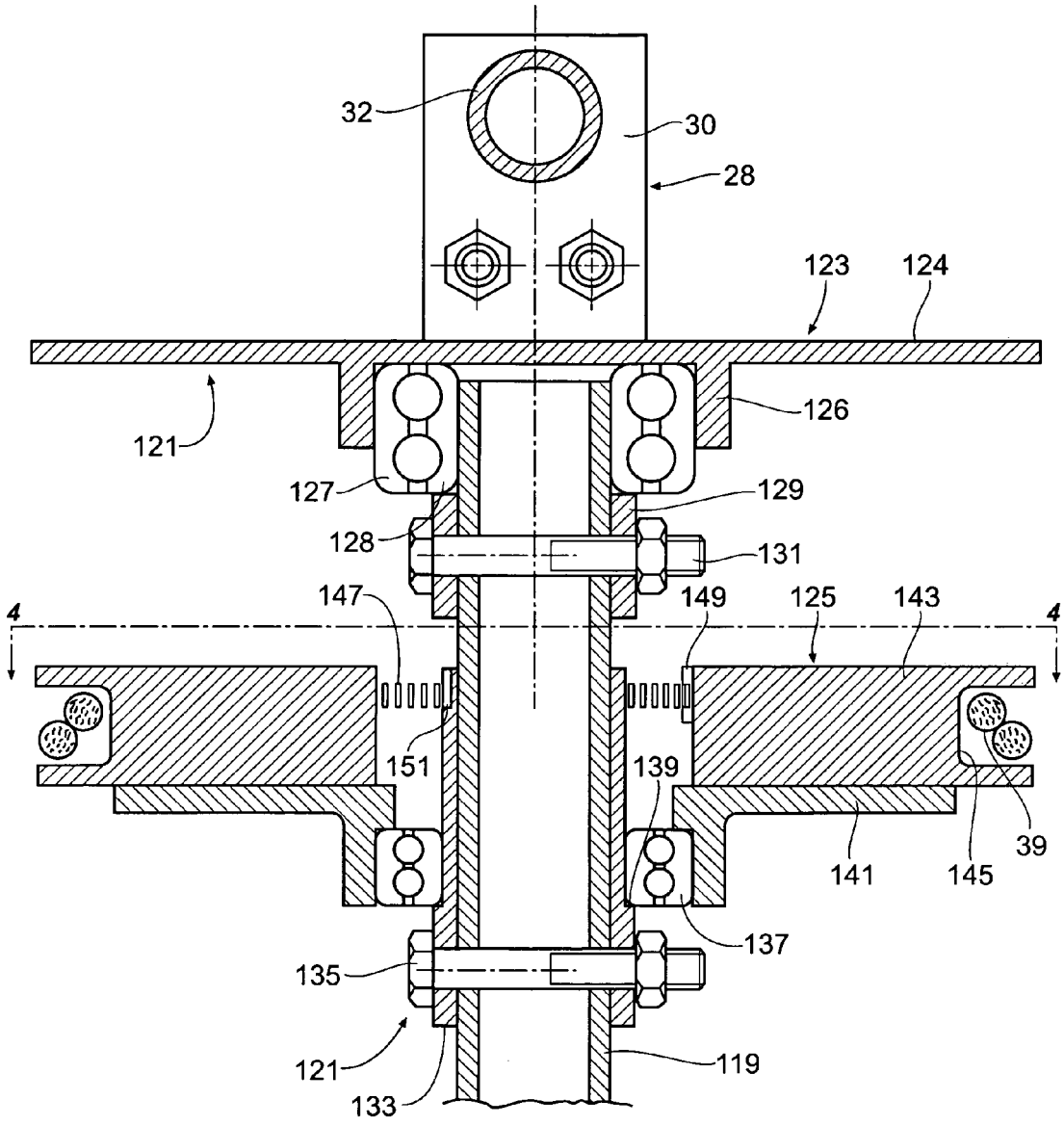
FIG. 3 is a cross-sectional view on an enlarged scale taken along line 3-3 of FIG. 2.
Figure 4:
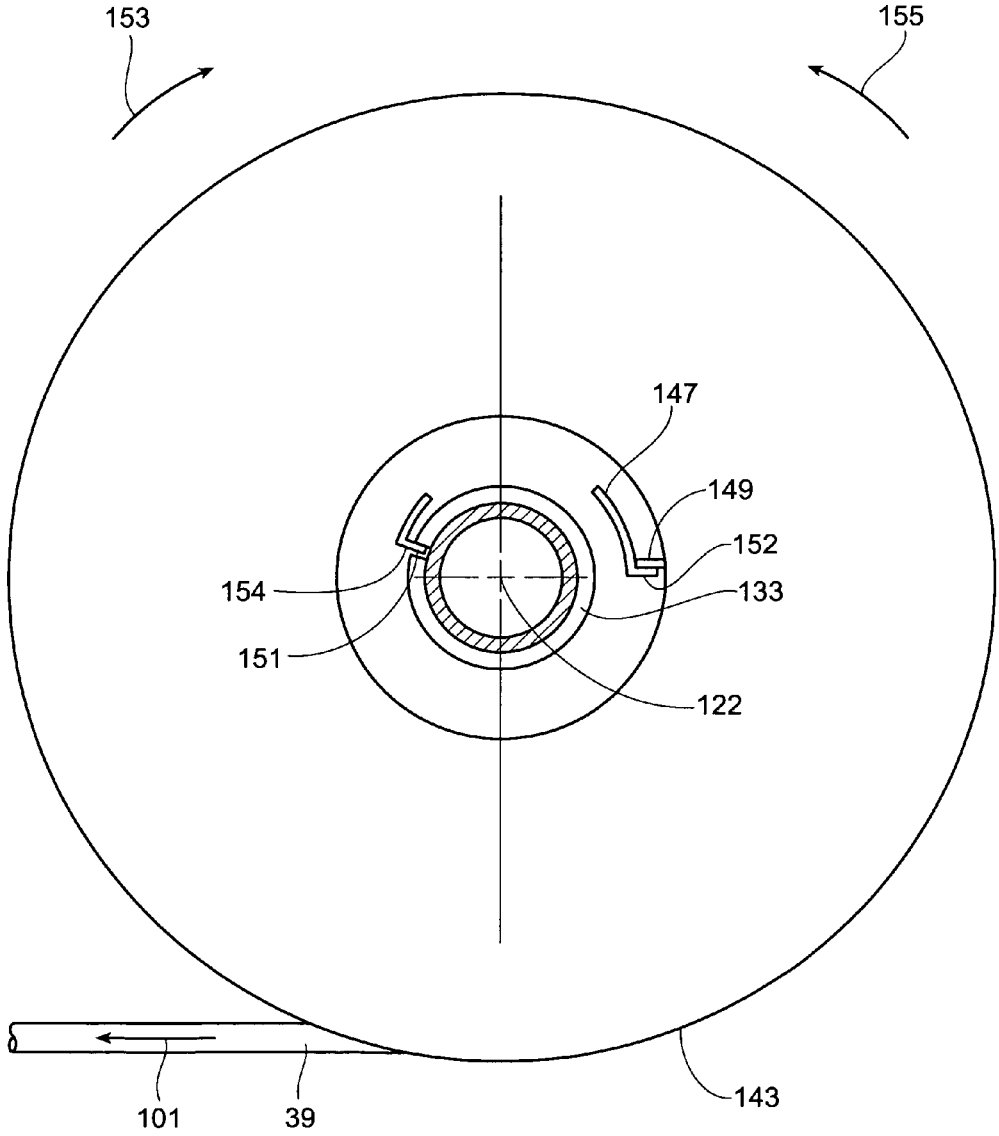
FIG. 4 is a cross-sectional view taken along line 4 of FIG. 3.

The auger 3 is unidirectionally rotated by manual operation of the recoil drive system 121. Looking also at FIGS. 3 and 4, the recoil drive system comprises a housing 123 and a recoil mechanism 125. The housing 123 includes a plate 124 and a tubular wall 126. Attached to the housing plate 124 is a handle 28. According to one aspect of the invention, the handle 28 is constructed with a pair of plates 30 welded or otherwise attached to the housing plate. A bar 32 is welded between two plates 30.

Received in the housing tubular wall 126 is a thrust bearing 127. The inner race 128 of the thrust bearing 127 is fit over the output shaft 119 to thereby guide the output shaft in the housing 123. A collar 129 with a bolt and nut 131 positively holds the thrust bearing in place on the output shaft.

The recoil mechanism 125 is assembled to the output shaft 119. For that purpose, a mounting sleeve 133 is secured to the output shaft, as by a bolt and nut 135. A one-way clutch bearing 137 is assembled over the mounting sleeve 133 and located against a shoulder 139 thereon. Any commercially available clutch bearing of adequate construction and torque capacity is suitable for the clutch bearing 137. An example of a suitable clutch bearing is a Model CSK25 marketed by Marland Clutch of Burr Ridge, Ill. Fit over the outer race of the clutch bearing is a flange 141. A rope wheel 143 is fastened to the flange 141 by conventional fasteners, not shown. In the outer periphery of the rope wheel 143 is a groove 145. A rope 39 is wound around the rope wheel groove 145. The rope 39 terminates in a rope pull handle 41.

There is a recoil spring 147 between the rope wheel 143 and the mounting sleeve 133. The recoil spring 147 hooks at one end 152 thereof to the rope wheel, as to a rib 149. The other end 154 of the recoil spring hooks to the mounting sleeve 133, such as in a slot 151.

The recoil spring 147, rope 39, and clutch bearing 137 are assembled in a definite relation to each other. The rope 39 is initially wound on the rope wheel 143 with the recoil spring 147 in a relaxed condition. Looking especially at FIG. 4, the rope is wound on the rope wheel such that pulling the rope with a straight line motion 101 rotates the rope wheel in the direction of arrow 153 about the longitudinal axis 122. Pulling the rope to rotate the rope wheel winds the recoil spring. Upon releasing the rope, under control, the bias of the wound recoil spring rotates the rope wheel 143 in the direction of arrow 155 to rewind the rope.

The clutch bearing 137 is assembled to the flange 141 and the mounting sleeve 133 such that rotating the rope wheel 143 in the direction of arrow 153 also rotates the mounting sleeve, and hence the output shaft 119, in the direction of arrow 153. Rotating the rope wheel in the direction of arrow 155 has no effect on the mounting sleeve or output shaft.

In operation, a person grasps the handle 28 of the recoil auger 1 with one hand 156, FIG. 1. With the other hand 158 he pulls the rope pull handle 41 in a pull stroke with the straight line motion 101, FIG. 2. Doing so rotates the rope wheel 143 in the direction of arrow 153 against the bias of the recoil spring 147 and also rotates the mounting sleeve 133, output shaft 119, and auger 3 because of the operation of the clutch bearing 137. At the end of the pull stroke, the person releases the rope pull handle, under control, in the straight line motion 103 in a return stroke. That action causes the recoil spring to rotate the rope wheel and flange 141 in the direction of arrow 155 to rewind the rope 39 on the rope wheel. During the return stroke, the clutch bearing 137 freewheels such that none of the rotating motion of the rope wheel and flange is imparted to the mounting sleeve. Consequently, the rotating rope wheel and flange in the direction of arrow 155 has no effect on the mounting sleeve. As a result, the output shaft and auger do not rotate during the return stroke. The cycle is repeated as often as necessary until the desired hole is drilled by the auger.

It is an important feature of the invention that the auger 3 is rotated about the longitudinal axis 122 using only the bidirectional straight line motions 101 and 103 of the persons's arm, hand, and shoulder. The problems associated with the multiple circular motions required for prior manual augers with offset handles is therefore eliminated. Even persons of modest strength are capable of drilling holes using the present invention.

As mentioned previously, the auger 3 is disconnectable from the recoil drive system 121 by means of the socket 107 and thumb screw 113. It will be appreciated, of course, that the auger shaft 11 and the recoil mechanism output shaft 119 may be a single integral piece, if desired.

Figure 2:
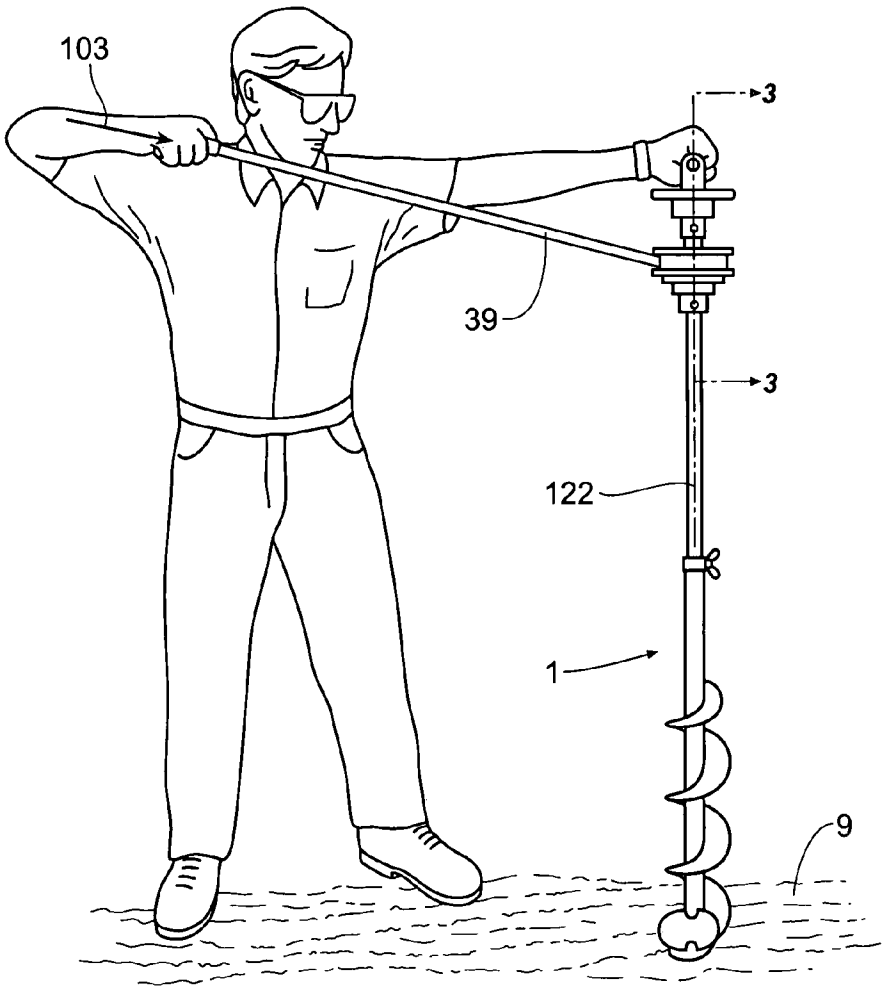
FIG. 2 is a view similar to FIG. 1, but showing the invention in use at the end of a pull stroke.
Figure 6:
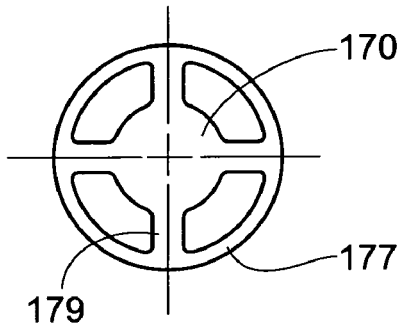
FIG. 6 is a top view on an enlarged scale of FIG. 5.
Figure 5:
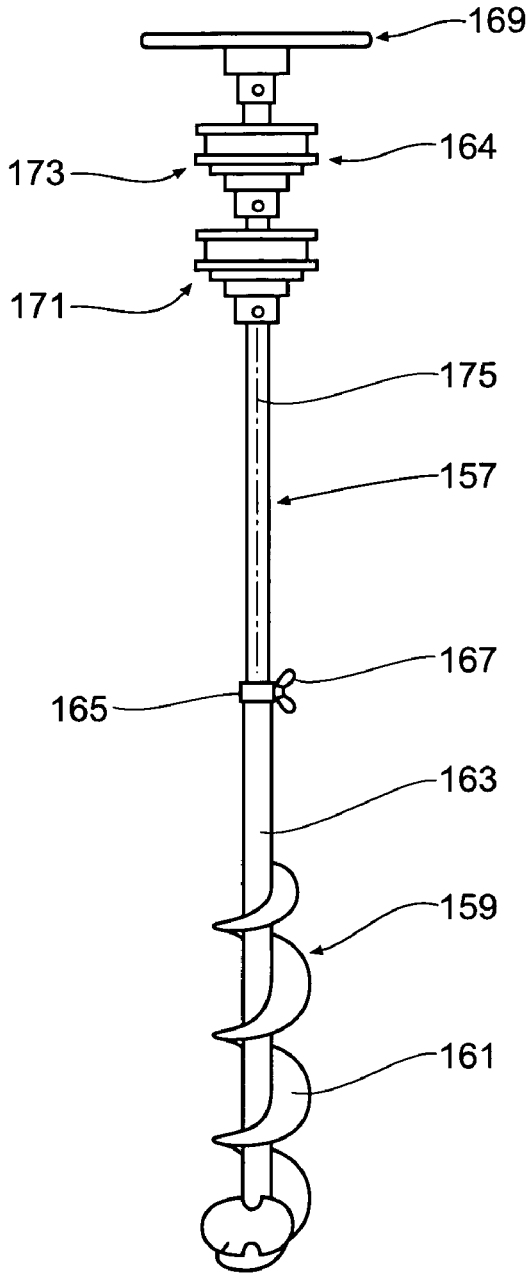
FIG. 5 is a front view of a modified embodiment of the invention.

Turning to FIGS. 5 and 6, a recoil auger 157 has an auger 159 with a blade 161 and auger shaft 163 that may be substantially identical to the corresponding components of the auger 3 of FIGS. 1 and 2. A recoil drive system 164 connects to the auger 159 by means of a socket 165 and thumb screw 167 in the auger shaft 163. The recoil drive system 164 has a housing 169, two recoil mechanisms 171 and 173, and an output shaft 175. The housing 169 includes a plate 170 that is rotatably mounted to the output shaft 175 in a manner similar to the thrust bearing 127 and collar 129 of the recoil drive system 121 of FIGS. 1-4. The recoil mechanisms 171 and 173 may be identical. Further, they may be identical to the recoil mechanism 125 of the recoil drive system 121 described previously. They also operate the same, except that a different person pulls the rope pull handle of each recoil mechanism 171 and 173. Because of the clutch bearings, pulling on the rope of one or other recoil mechanism 171 or 173 has no effect on the operation of the other recoil mechanism. Thus, it is not necessary for the two persons to pull or release their respective pull handles simultaneously. It will be appreciated, of course, that three or even more recoil mechanisms can be incorporated into the recoil auger, if desired. The result of multiple recoil mechanisms is a faster drilling of a hole by the auger 159.

To enable two or more persons to operate the recoil auger 157, the housing 169 has a handle in the form of a circular gripping ring 177. Also see FIG. 6. The ring 177 includes spokes 179 that span to the housing plate 170.

Figure 7:
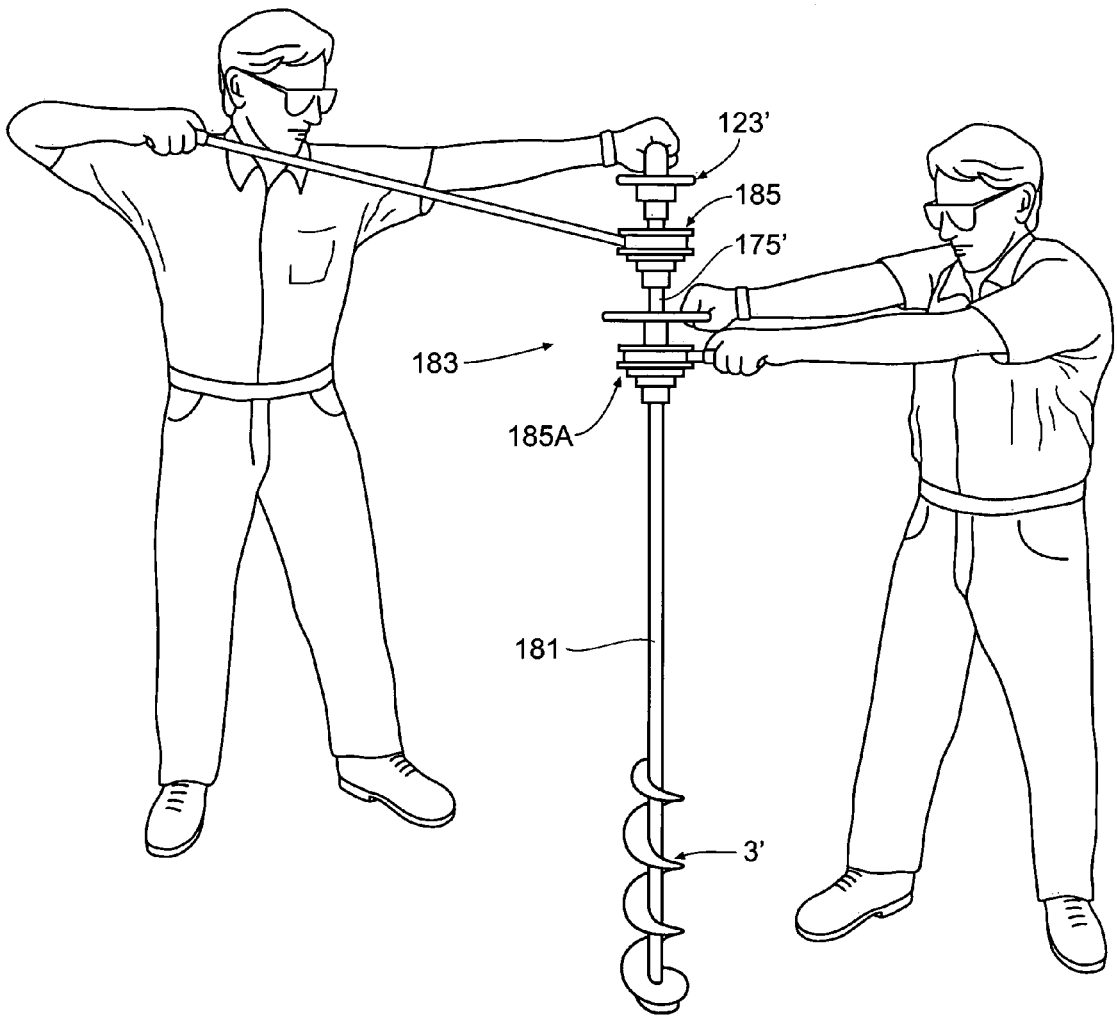
FIG. 7 is a perspective view of an embodiment of the invention that incorporates dual recoil mechanisms each with its own handle.
Figure 8:
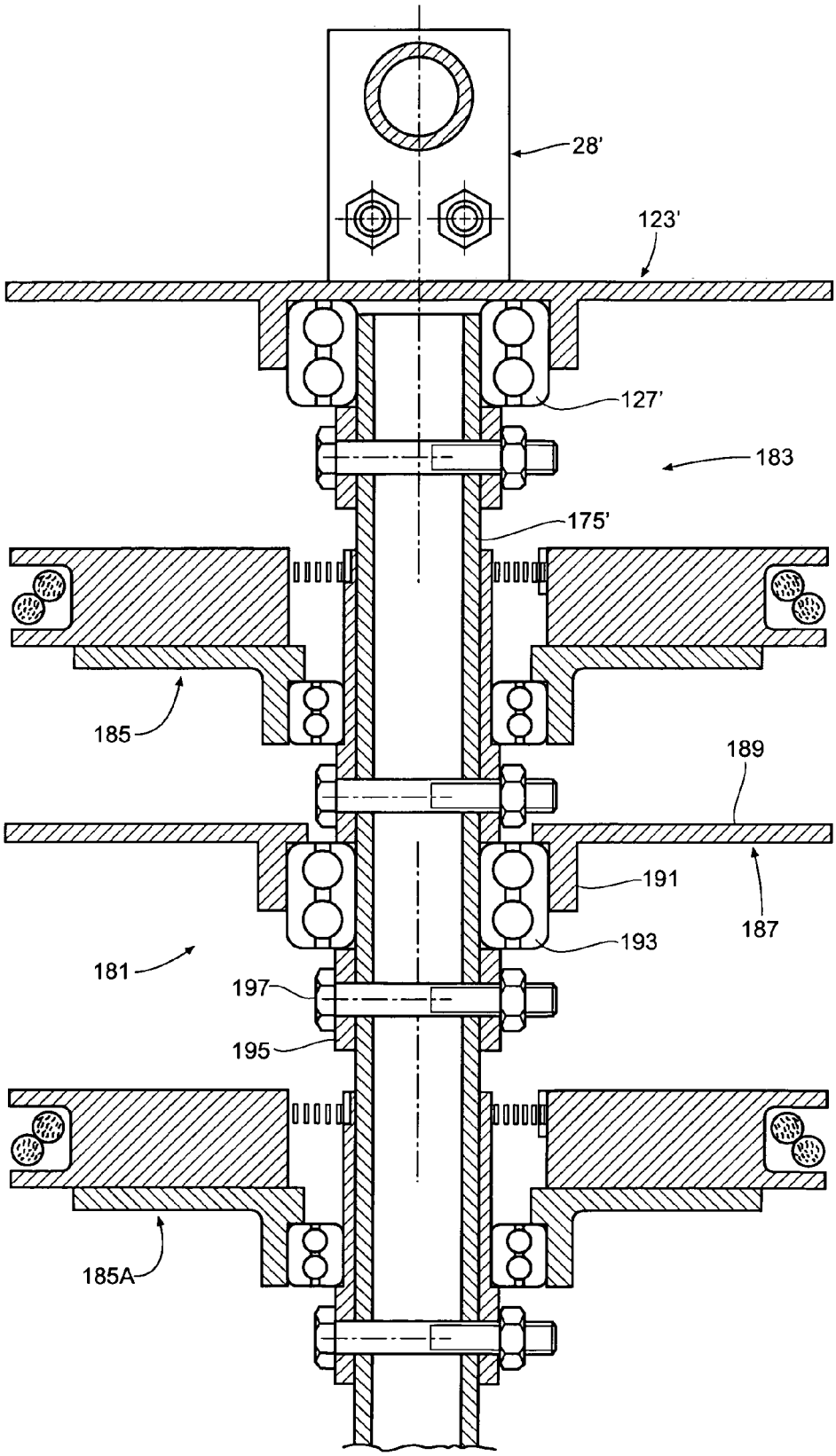
FIG. 8 is a partial longitudinal cross-sectional view of the embodiment of FIG. 7.

FIGS. 7 and 8 show a recoil auger 181 having an auger 3' that is substantially identical to the auger 3 described above. A recoil drive system 183 connects to the auger 3'. The recoil drive system 183 has two substantially identical recoil mechanisms 185 and 185A each being substantially identical to the recoil mechanism 171 described above, and an output shaft 175'. The recoil drive system 183 further has a housing 123', bearing 127', and handle 28' that are substantially identical to the housing 123, bearing 127, and handle 28, respectively, described previously in conjunction with FIG. 3. It will be appreciated, of course, that a housing similar to the housing 169 of FIGS. 6 and 7 may be substituted for the housing 123' and handle 28', if desired.

Between the recoil mechanisms 185 and 185A is a gripping ring 187. The gripping ring 187 has a plate 189 with a tubular wall 191. A bearing 193 is pressed into the wall 191 and over the output shaft 175'. The bearing 193 is held in place by a collar 195 and bolt and nut 197. The plate 189 may be configured like the plate 170, in that it has a circular gripping ring and spokes analogous to the ring 177 and spokes 179 described in conjunction with FIG. 6.

In summary, the results and advantages of holes in ice and earth can now be more fully realized. The recoil auger with clutch bearing of the invention provides both an ergonomically sound way to manually operate an auger as well as unidirectional rotation of the auger. This desireable result comes from using the combined functions of the recoil drive system. The handle provides a good grip for a person's first hand. The recoil mechanism rotates the auger in response to straight line motions and of the person's second hand, arm, and shoulder. The person exerts the straight line motions on the rope pull handle to selectively wind and unwind the rope on the rope wheel. The clutch bearing 137 rotates the auger when the rope is pulled, but the clutch bearing freewheels during the rope return stroke. Dual recoil mechanisms enable two persons to simultaneously operate the recoil auger.

It will also be recognized that in addition to the superior performance of the recoil auger of the invention, its construction is such as to to be of modest cost in relation to the benefits it provides. Its ergonomically superior design more than compensates for any increased cost relative to prior ergonomically unsatisfactory manual augers.

Thus, it is apparent that there has been provided, in accordance with the invention, a recoil auger with clutch bearing that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I Claim:

1. A recoil auger comprising:

a. an auger having an auger shaft; and b. at least one recoil mechanism connected to the auger shaft for manually unidirectionally rotating the auger about a longitudinal axis in response to a person exerting bi-directional straight line motions with a first hand, arm, and shoulder of the person, wherein the at least one recoil mechanism comprises;

i. an output shaft connected to the auger shaft;

ii. a housing that rotatably guides the output shaft; and iii. a plurality of recoil mechanisms connected to the auger shaft each including a rope wheel that rotates in first and second directions, the output shaft rotating in the first direction in response to any rope wheel rotating in the first direction, the output shaft being stationary in response to no rope wheel rotating in the first direction.

2. The recoil auger of claim 1 wherein the housing comprises a circular ring that enables multiple persons to grasp the handle.

3. A recoil auger comprising:

a. an auger having an auger shaft; and b. at least one recoil mechanism connected to the auger shaft for manually unidirectionally rotating the auger about a longitudinal axis in response to a person exerting bi-directional straight line motions with a first hand, arm, and shoulder of the person, wherein the recoil mechanism comprises;

i. an output shaft connected to the auger shaft;

ii. a plurality of recoil mechanisms connected to the output shaft each including a rope wheel that rotates in first and second directions, the output shaft rotating in the first direction in response to any rope wheel rotating in the first direction, the output shaft being stationary in response to no rope wheel rotating in the first direction; and iii. a plurality of housings each graspable by a different person, so that the recoil mechanism is operable by a plurality of persons each grasping a respective housing.

4. Apparatus for drilling holes comprising:

a. an auger having an auger shaft; and b. a recoil drive system connected to the auger shaft for unidirectionally rotating the auger shaft and comprising a first recoil mechanism assembled to the auger shaft and comprising a first rope wheel, and a first clutch bearing that unidirectionally rotates the auger shaft in response to bidirectional rotation of the first rope wheel, wherein the recoil drive system further comprises:

i. an output shaft connected to the auger shaft; and ii. a second recoil mechanism assembled to the output shaft and comprising a second rope wheel, and a second clutch bearing that unidirectionally rotates the auger shaft in response to bi-directional rotation of the second rope wheel.

5. The apparatus of claim 4 wherein the recoil drive system further comprises:

a. an output shaft connected to the auger shaft; and b. a housing that rotatably guides the output shaft.

6. The apparatus of claim 4 wherein the housing comprises a handle configured to be grasped by multiple persons.

7. The apparatus of claim 4 further comprising;

a. a first housing in operative association with the first recoil mechanism and configured to be grasped by a first person; and b. a second housing in operative association with the second recoil mechanism and configured to be grasped by a second person.

8. The apparatus of claim 7 wherein the second housing is located between the first and second recoil mechanisms.

9. A method of drilling holes comprising the steps of:

a. providing an auger having an auger shaft;

b. placing the auger in contact with a material to be drilled;

c. providing a recoil drive system having an output shaft, wherein the step of providing a recoil mechanism comprises the step of assembling multiple recoil mechanisms to the output shaft;

d. connecting the auger shaft to the output shaft, wherein the step of connecting the auger shaft to the output shaft comprises the step of providing a housing, and guiding the output shaft in the housing;

e. exerting a first motion on the recoil drive system in a first straight line direction and rotating the auger in a first rotational direction, wherein the step of exerting the first motion comprises the step exerting the first motion on each of the recoil mechanisms; and f. exerting a second motion on the recoil drive system in a second straight line direction opposite the first straight line direction without rotating the auger.

10. The method of claim 9 wherein:

a. the step of assembling multiple recoil mechanisms comprises the step of providing a rope wheel for each recoil mechanism;

b. the step of exerting the first motion comprises the step of exerting the first motion on each rope wheel and thereby rotating the output shaft in the first rotational direction; and c. the step of exerting the second motion comprises the steps of rotating the rope wheels in the second rotational direction, and enabling the output shaft to be stationary.

11. The method of claim 10 comprising the further steps of:

a. providing a handle on the output shaft;

b. grasping the handle by multiple persons; and c. exerting the first motion on each of the multiple recoil mechanisms by the respective multiple persons.

12. A method of drilling holes comprising the steps of:

a. providing an auger having an auger shaft;

b. placing the auger in contact with a material to be drilled;

c. providing a recoil drive system having an output shaft;

d. connecting the auger shaft to the output shaft;

e. exerting a first motion on the recoil drive system in a first straight line direction and rotating the auger in a first rotational direction;

f. exerting a second motion on the recoil drive system in a second straight line direction opposite the first straight line direction without rotating the auger;

g. assembling first and second recoil mechanisms to the output shaft;

h. assembling first and second handles to the output shaft;

i. grasping the first handle and exerting the first and second motions on the first recoil mechanism; and j. grasping the second handle and exerting the first and second motions on the second recoil mechanism.

13. The method of claim 12 wherein:

a. the step of providing a recoil drive system comprises the step of providing a recoil drive system having a handle; and b. the steps of exerting the first and second motions comprise the steps of grasping the handle with a first hand, and exerting the first and second motions with a second hand.

14. The method of claim 12 wherein;

a. the step of providing a recoil drive system comprises the step of providing the recoil drive system with a rope wheel and a clutch bearing; and b. the step of exerting the first motion comprises the step of rotating the rope wheel in a first rotational direction and causing the clutch bearing to rotate the output shaft in the first rotational direction.

15. The method of claim 14 wherein the step of exerting the second motion comprises the steps of rotating the rope wheel in a second rotational direction, and enabling the output shaft to be stationary during rotation of the rope wheel in the second rotational direction.

* * * * *